US009827463B2

(12) United States Patent
Chuang

(10) Patent No.: US 9,827,463 B2
(45) Date of Patent: Nov. 28, 2017

(54) WRIST EXERCISER

(71) Applicant: NANO-SECOND TECHNOLOGY CO.,LTD., New Taipei (TW)

(72) Inventor: Pei-Sung Chuang, New Taipei (TW)

(73) Assignee: NANO-SECOND TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/934,985

(22) Filed: Nov. 6, 2015

(65) Prior Publication Data

US 2016/0367852 A1 Dec. 22, 2016

(30) Foreign Application Priority Data

Jun. 17, 2015 (TW) ..... 104209755 U

(51) Int. Cl.
*A63B 23/14* (2006.01)
*A63B 21/22* (2006.01)
*A63B 71/00* (2006.01)

(52) U.S. Cl.
CPC ..... *A63B 23/14* (2013.01); *A63B 21/222* (2015.10); *A63B 2071/0063* (2013.01); *A63B 2220/34* (2013.01)

(58) Field of Classification Search
CPC ..... A63B 23/14; A63B 21/4035; A63B 23/03508; A63B 23/16; A63B 21/22; A63B 21/222; A63B 21/00069; A63B 21/0004; A63B 21/4049; A63B 2023/003; A63B 23/12; A63B 21/015; A63B 23/03541; A63B 21/4043; A63B 2207/02; A63B 2210/50
USPC ..... 482/44–50
See application file for complete search history.

(56) References Cited

U.S. PATENT DOCUMENTS

| | | | | |
|---|---|---|---|---|
| 5,800,311 | A * | 9/1998 | Chuang | A63B 21/22 482/2 |
| 6,053,846 | A * | 4/2000 | Lin | A63B 21/22 482/110 |
| 6,186,914 | B1 * | 2/2001 | Lin | A63B 21/22 473/570 |
| 7,381,155 | B2 * | 6/2008 | Chuang | A63B 21/22 482/127 |
| 7,736,275 | B2 * | 6/2010 | Chuang | A63B 21/22 446/233 |
| 2002/0068663 | A1 * | 6/2002 | Smith | A63B 21/22 482/45 |

(Continued)

*Primary Examiner* — Andrew S Lo
(74) *Attorney, Agent, or Firm* — Maschoff Brennan

(57) ABSTRACT

A wrist exerciser includes a housing and a gyroscopic member. The housing includes a first cover, a second cover, a supporting portion and a protective assembly. The supporting portion and the protective assembly are disposed between the first cover and the second cover. Two ends of the supporting portion that are opposite to each other are in contact with the first cover and the second cover, respectively. A stiffness of the supporting portion is greater than a stiffness of the protective assembly. The protective assembly includes a rail and a buffer portion that are corresponding to each other. The gyroscopic member includes a ring and a rotor. The ring is slidably disposed on the rail. The rotor includes a ball disposed in the housing and a shaft which penetrates the ball. Two ends of the shaft that are opposite to each other are pivotally connected to the ring.

17 Claims, 7 Drawing Sheets

(56) References Cited

U.S. PATENT DOCUMENTS

| | | | | |
|---|---|---|---|---|
| 2004/0048720 | A1* | 3/2004 | Kuo | A63B 21/22 482/45 |
| 2004/0063546 | A1* | 4/2004 | Chuang | A63B 21/22 482/45 |
| 2005/0107218 | A1* | 5/2005 | Chuang | A63B 23/14 482/45 |
| 2005/0113214 | A1* | 5/2005 | Chuang | A63B 21/225 482/44 |
| 2010/0048359 | A1* | 2/2010 | Chuang | A63B 21/22 482/44 |
| 2012/0302407 | A1* | 11/2012 | Kelliher | A63B 21/22 482/45 |
| 2013/0012361 | A1* | 1/2013 | Smith | A63B 21/22 482/44 |
| 2014/0378278 | A1 | 12/2014 | Chuang | |

* cited by examiner

WRIST EXERCISER

CROSS-REFERENCE TO RELATED APPLICATIONS

This non-provisional application claims priority under 35 U.S.C. §119(a) on Patent Application No(s). 104209755 filed in Taiwan, R.O.C. on Jun. 17, 2015, the entire contents of which are hereby incorporated by reference.

TECHNICAL FIELD

The disclosure relates to a training apparatus, more particularly to a wrist exerciser.

BACKGROUND

In general, a wrist exerciser includes a housing, a ring and a rotor. The housing includes a rail, and the ring is slidably disposed on the rail. The rotor includes a ball and a shaft. The shaft penetrates the ball, and two ends of the shaft that are opposite to each other are pivoted to the ring. The wrist exercisers utilize the principle of a gyroscope. When a spinning of the wrist exerciser is initiated by a mechanical way, the ball starts spinning in the interior of the housing and a strong spinning force generated by the centrifugal force and the inertia of the ball. Therefore, the user's wrists and shoulders are trained by resisting the spinning force.

SUMMARY

One embodiment of the disclosure provides a wrist exerciser including a housing and a gyroscopic member. The housing has a first cover, a second cover, at least one supporting portion and at least one protective assembly. The supporting portion and the protective assembly are disposed between the first cover and the second cover. Two ends of the supporting portion that are opposite to each other are in contact with the first cover and the second cover, respectively, and a stiffness of the supporting portion is greater than a stiffness of the protective assembly. The protective assembly has a rail and a buffer portion, the buffer portion is corresponding to the rail. The gyroscopic member includes a ring and a rotor. The ring is disposed in the housing and slidably disposed on the rail. The rotor includes a ball and a shaft, the ball is disposed in the housing and penetrated by the shaft, and two ends of the shaft that are opposite to each other are pivotally connected to the ring, respectively.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1:
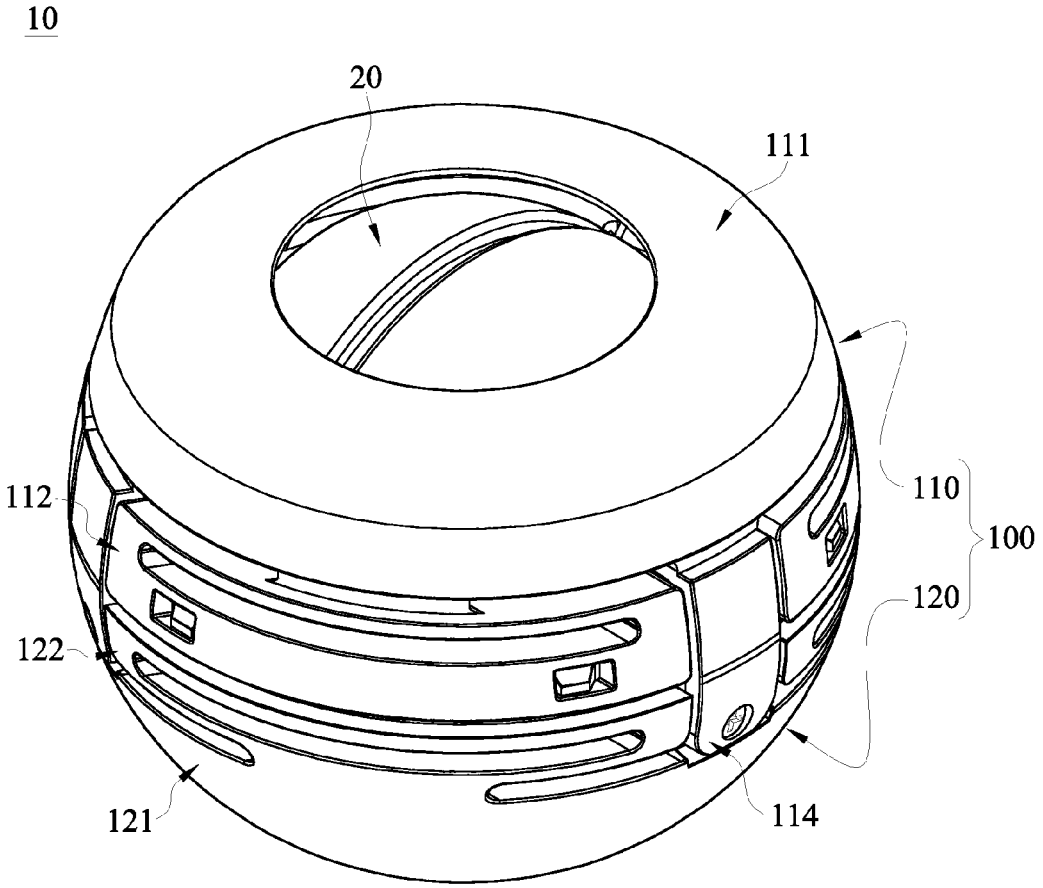
FIG. 1 is a perspective view of a wrist exerciser according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
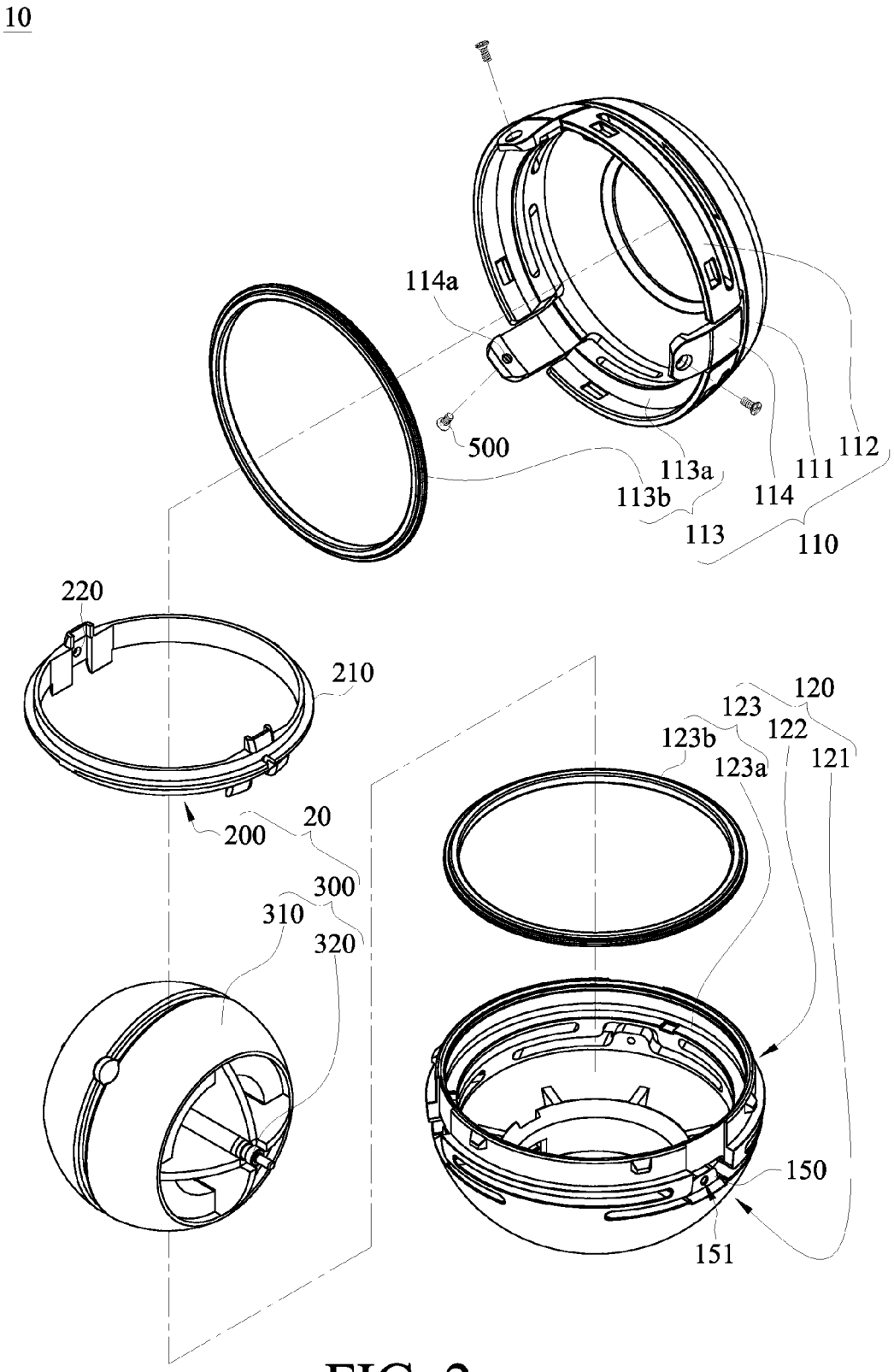
FIG. 2 is an exploded view of the wrist exerciser according to FIG. 1.
Figure 3:
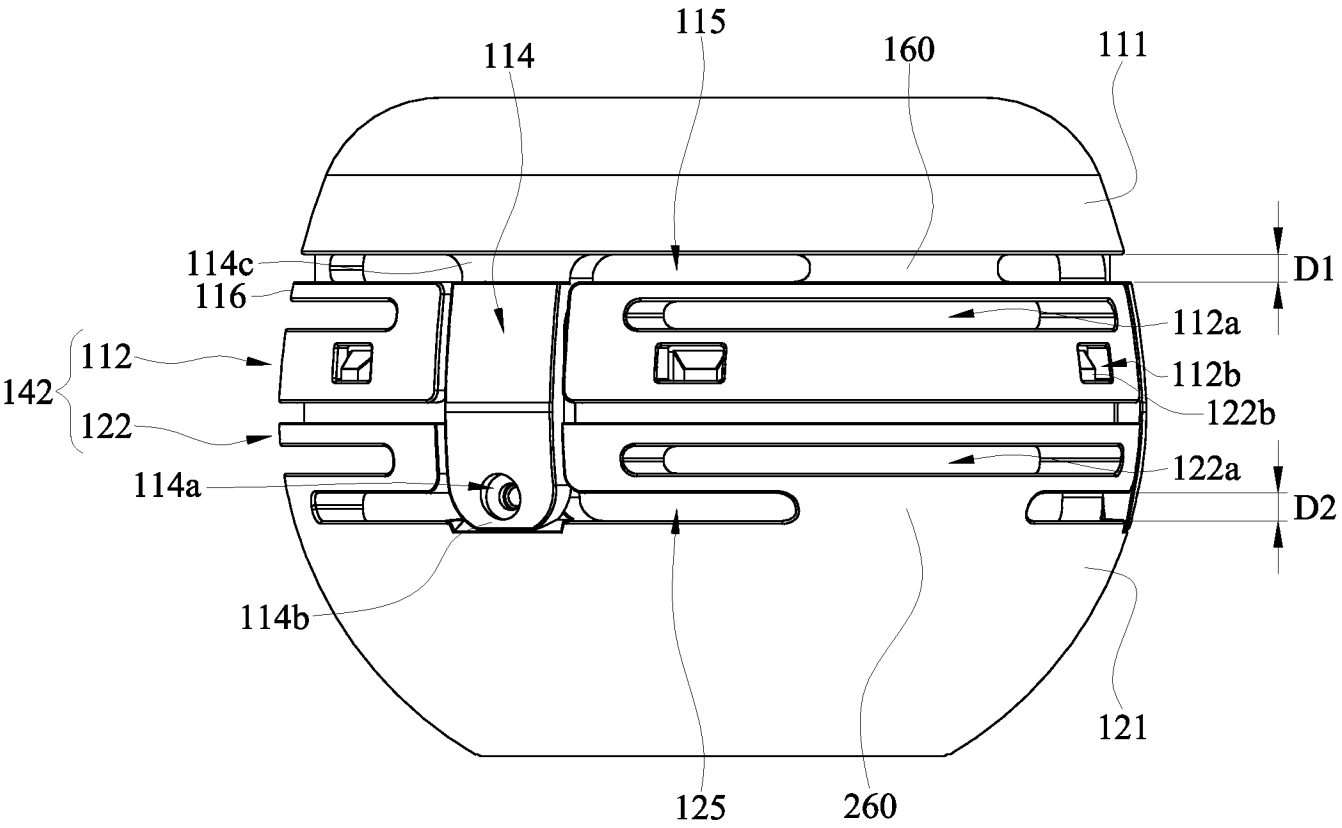
FIG. 3 is a front view of the wrist exerciser according to FIG. 1.
Figure 4:
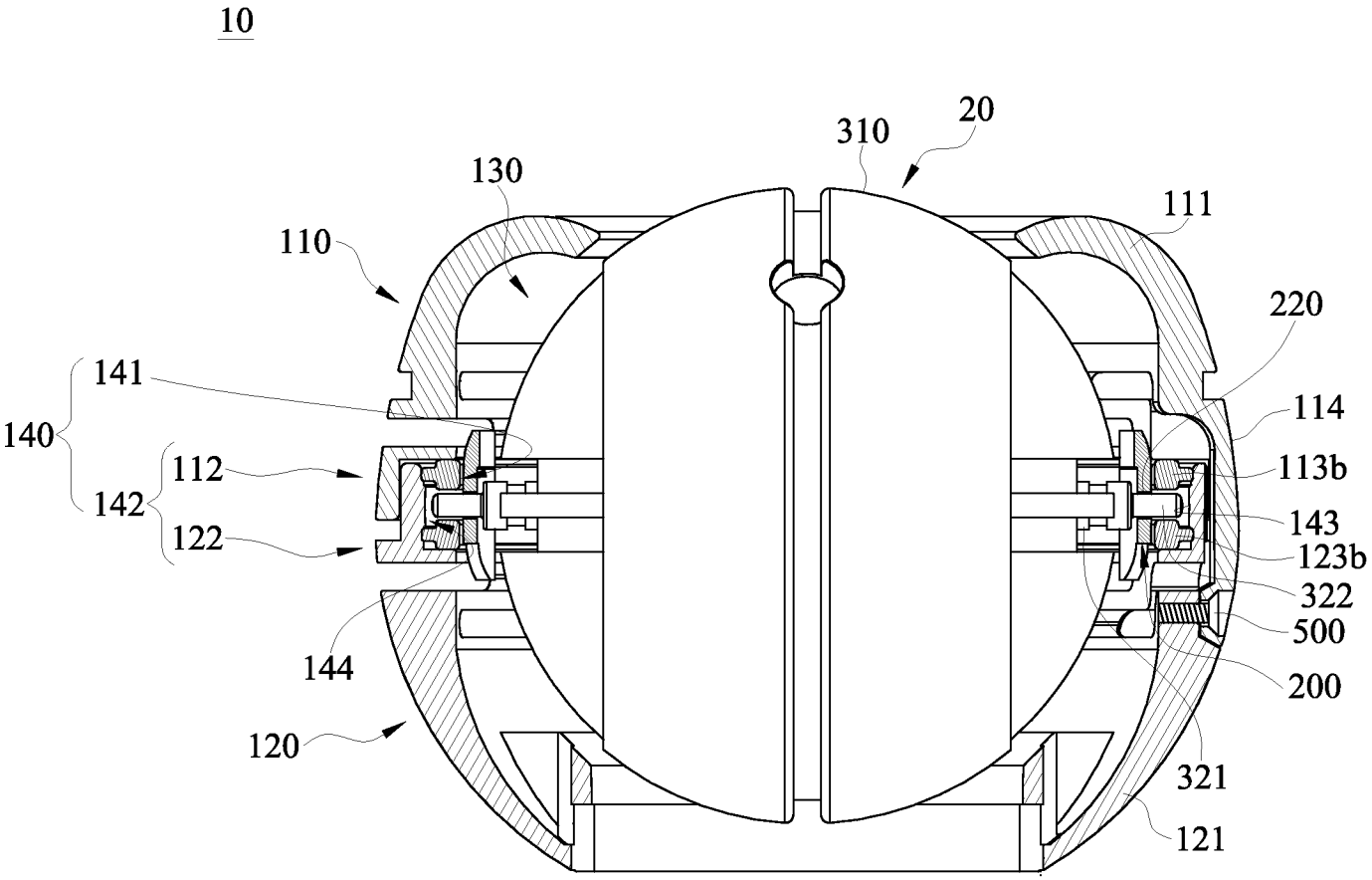
FIG. 4 is a cross-sectional view of the wrist exerciser according to FIG. 1.

Please refer to FIGS. 1-4. FIG. 1 is a perspective view of a wrist exerciser according to an embodiment of the disclosure. FIG. 2 is an exploded view of the wrist exerciser according to FIG. 1. FIG. 3 is a front view of the wrist exerciser according to FIG. 1. FIG. 4 is a cross-sectional view of the wrist exerciser according to FIG. 1. In the disclosure, the term "in contact" means an object presses against another object or two objects are in contact without a pressure between thereof. The disclosure provides a wrist exerciser 10, and the wrist exerciser 10 includes a housing 100 and a gyroscopic member 20. The gyroscopic member 20 is disposed in the housing 100.

The housing 100 includes a first cover 111, a second cover 121, at least one supporting portion 114, at least one protective assembly 140, a first connecting portion 160, a first rail 113 and a second rail 123. The supporting portion 114 and the protective assembly 140 both are disposed between the first cover 111 and the second cover 121. Two ends of the supporting portion 114 that are opposite to each other are connected to the first cover 111 and the second cover 121, respectively. A stiffness of the supporting portion 114 is greater than a stiffness of the protective assembly 140. In this and some embodiments, a quantity of the supporting portion 114 is three, and a quantity of the protective assembly 140 is three, but the disclosure is not limited to the quantity of the supporting portion 114 and the protective assembly 140. In other embodiments, the quantity of the supporting portion can be one, two or more than three, and the quantity of the protective assembly can be one, two or more than three. In this and some embodiments, each of the supporting portions 114 is equally spaced apart from the adjacent supporting portion 114, and each of the supporting portions 114 is disposed between every two protective assemblies 140 which are adjacent to each other.

The detailed configuration of the housing 100 will be depicted in the following description. The housing 100 includes a first shell 110 and a second shell 120. In this embodiment, the protective assembly 140 includes a first buffer component 112 and a second buffer component 122. The first buffer component 112, the first cover 111, the supporting portion 114 and the first rail 113 are disposed on the first shell 110. The second cover 121, the second buffer component 122 and the second rail 123 are disposed on the second shell 120. The first cover 111 is disposed on a side of the first shell 110, and the first rail 113 is disposed on an edge of the opposite side of the first shell 110. Similarly, the second cover 121 is disposed on a side of the second shell 120, and the second rail 123 is disposed on an edge of the opposite side of the second shell 120. The first buffer component 112 is detachably connected to the second buffer component 122. The first shell 110 is mounted on the second shell 120 to form an accommodating space 130 together for accommodating the gyroscopic member 20.

In this and some embodiments, two ends of the supporting portion 114 that are opposite to each other are in contact with the first cover 111 and the second cover 121, respectively. The supporting portion 114 has a free end 114*b* and a fixed end 114*c*. The fixed end 114*c* of the supporting portion 114 is directly in contact with the first cover 111. More specifically, in this embodiment, the supporting portion 114 and the first cover 111 are formed as a single unit. The free end 114*b* of the supporting portion 114 is in contact with the second cover 121.

In this and some embodiments, the first buffer component 112 includes a hook slot 112*b*, and the second buffer component 122 includes a hook 122*b*. The hook 122*b* of the second buffer component 122 is detachably fixed to the hook slot 112*b* of the first buffer component 112. Thus, the first shell 110 and the second shell 120 are detachably fixed to each other by the hook 122*b* and the hook slot 112*b*.

As shown in FIG. 3, in this and some embodiments, the first buffer component 112 is connected to the first cover 111 through the first connecting portion 160, and the supporting portion 114 and the first buffer component 112 are spaced apart. In addition, a width of the first connecting portion 160 is less than a width of the first buffer component 112, and therefore a first slot 115 is formed between the first cover 111, the first buffer component 112, the first connecting portion 160 and the supporting portion 114. As a result, the first buffer component 112 and the first cover 111 are spaced apart by a first distance D1. Similarly, the second shell 120 includes a second connecting portion 260, and the second buffer component 122 is connected to the second cover 121 through the second connecting portion 260. A second slot 125 is formed between the second cover 121, the second buffer component 122 and the second connecting portion 260. Therefore, the second buffer component 122 and the second cover 121 are spaced apart by a second distance D2. In this and some embodiments, a quantity of the first connecting portion 160, the first buffer component 112, the second buffer component 122 and the second connecting portion 260 are plural. However, the present disclosure is not limited to the quantity of the first connecting portion 160, the first buffer component 112, the second buffer component 122 and the second connecting portion 260.

In this and some embodiment, the first buffer component 112 has a plurality of first channels 112*a*. Orthogonal projections of the first channels 112*a* and the first slots 115 on the first cover 111 show a rotating order. The second buffer component 122 has a plurality of second channels 122*a*. Orthogonal projections of the second channels 122*a* and the second slots 125 on the first cover 111 show a rotating order. In this and some embodiments, the first channels 112*a* and the second channels 122*a* are both parallel to the first slots 115 and the second slots 125. The first channels 112*a* are corresponding to the second channels 122*a*, which means that an orthogonal projection of the first channel 112*a* on the rail 141 is totally overlapped with an orthogonal projection of the second channel 122*a* on the rail 141. However, the present disclosure is not limited to a quantity of the first channel 112*a* and the second channel 122*a*. In some embodiments, the quantity of the first channel 112*a* is one, and the quantity of the second channel 122*a* is one.

In this and some embodiments, the wrist exerciser 10 further includes a fixing member 500, and the housing 100 further has a fixed portion 150. The fixed portion 150 is connected to the second cover 121 and extending toward the first cover 111. The supporting portion 114 has a first fixing hole 114*a*, and the fixed portion 150 has a second fixing hole 151. The fixing member 500 penetrates the first fixing hole 114*a* and the second fixing hole 151. For example, the fixing member 500 is a screw, and the first fixing hole 114*a* and the second fixing hole 151 both are screw hole having female thread corresponding to the screw. When the fixing member 500 penetrates and fixed the first fixing hole 114*a* and the second fixing hole 151 together, the supporting portion 114 is firmly fixed between the first cover 111 and the second cover 121 so that the opposite two ends of the supporting portion 114 are more firmly connected to the first cover 111 and the second cover 121, respectively.

The detailed configurations of the protective assembly 140 will be depicted in the following description. The protective assembly 140 has a rail 141 and a buffer portion 142. The location of buffer portion 142 is corresponding to the location of the rail 141. Specifically, the rail 141 is formed by the first buffer component 112 and the second buffer component 122 of the protective assembly 140. A quantity of the protective assembly 140 is plural. Each of the rails 141 of the protective assemblies 140 is connected to the adjacent rails 141 in a row, and the supporting portion 114 is across the rails 141. In this and some embodiments, the rails 141 are connected to the second buffer component 122.

In this embodiment, each buffer portion 142 includes the aforementioned first buffer component 112 and the second buffer component 122. However, in some embodiments, the buffer portion 142 only includes the first buffer component 112 of the first shell 110 but the second buffer component 122. In some embodiments, the buffer portion 142 includes the second buffer component 122 of the second shell 120 but the first buffer component 112.

In detail, the rail 141 has an inner surface 143 facing the accommodating space 130. An annular groove 144 is disposed on the inner surface 143.

In this embodiment, the first cover 111, the second cover 121 and the rail 141 are made of, for example, plastic, but the present invention is not limited to the materials of the first cover 111, the second cover 121 and the rail 141. In some embodiments, the first cover 111, the second cover 121 and the rail 141 are made of metal.

In addition, in this embodiment, a distance between a left inner wall and a right inner wall of the first channel 112*a* gradually decreased along a direction from the outer surface 116 to the inner surface 143 of the first shell 110, but the disclosure is not limited thereto. In some embodiments, the left inner wall and the right inner wall of the first channel 112*a* are parallel to each other or a distance between the left inner wall and the right inner wall of the first channel 112*a* gradually increased along a direction from the outer surface 116 to the inner surface 143 of the first shell 110. A left inner wall and a right inner wall of the second channel 122*a* are similar to the left inner wall and the right inner wall of the first channel 112*a*, and, for example, a distance between the left inner wall and the right inner wall of the second channel 122*a* gradually decreased along the direction from the outer surface 116 to the inner surface 143 of the second shell 120.

In this embodiment, the first rail 113 further includes a first supporting groove 113*a* and a first supporting ring 113*b*. The first supporting ring 113*b* is detachably disposed in the first supporting groove 113*a*. The second rail 123 further includes a second supporting groove 123*a* and a second supporting ring 123*b*. The second supporting ring 123*b* is detachably disposed in the second supporting groove 123*a*.

The first rail 113 and the second rail 123 together form the annular groove 144 of the rail 141. The annular groove 144 surrounds the inner surface 143 of the housing 100. Extending directions of the first channels 112*a* and the second channels 122*a*, for example, are parallel to the annular groove 144.

The gyroscopic member 20 includes a ring 200 and a rotor 300. The ring 200 and the rotor 300 are disposed in the accommodating space 130. The ring 200 is slidably disposed on the rail 141. The ring 200 includes an annular protrusion 210 and two pivot holes 220. The annular protrusion 210 protrudes from an outer wall of the ring 200. The annular protrusion 210 is slidably disposed in the annular groove 144. The two pivot holes 220 are opposite to each other. The rotor 300 in the accommodating space 130 includes a ball 310 and a shaft 320. The ball 310 is disposed in the housing 100. The shaft 320 has a supporting section 321 and two pivoting sections 322. The two pivoting sections 322 are connected by the supporting section 321. A diameter of each pivoting section 322 is less than a diameter of the supporting section 321. The supporting section 321 penetrates the ball 310. The two pivoting sections 322 protrude from the ball 310 and are pivotally connected to the pivot holes 220 of the ring 200, and thus the two pivoting sections 322 are able to rotate relative to the ring 200.

Because a stiffness of the supporting portion 114 is greater than a stiffness of the protective assembly 140, when a user grips and applies force to the housing 100 of the wrist exerciser 10, the supporting portion 114 is able to support the first cover 111 as well as the second cover 121 and maintain a required distance for the ball 310 to rotate between the first cover 111 and the second cover 121. Therefore, when a strong grip is applied on the housing 100, the deformation of the housing 100 is limited for maintaining the function of the ball 310.

When an impact is applied on the housing 100, the first slot 115, the second slot 125, the first channel 112*a* and the second channel 122*a* of the protective assembly 140 are deformed and absorb the impact for reducing the impact transmitted to the gyroscopic member 20.

For example, when the wrist exerciser 10 is accidentally dropped on the floor, an impact is applied on the housing 100, the first channel 112*a* and the second channel 122*a* of the protective assembly 140 are able to absorb the impact. Furthermore, when the impact applied to the housing 100 deform the second buffer component 122 in the second shell 120, the rail 141 is able to move with the second buffer component 122 within the maximum displacement determined by the buffer ability of the second buffer component 122, and therefore the shaft and the ball are able to move toward the second cover 121 with the rail 141.

In detail, the wrist exerciser 10 has two protection mechanisms for protecting the structure of the wrist exerciser 10 when the impact F is applied. The first protection mechanism is functioning when the ball 310 is not in contact with the housing 100. The first protection mechanism is that the rail 141 is able to bring the ball 310 and the shaft 320 to move together as the second buffer component 122 is deformed for minimizing the stress concentrated on the pivoting sections 322 and the supporting section 321 of the shaft 320. Thus, by the first protection mechanism, the deformation of the shaft 320 is avoided.

The second protection mechanism is functioning when the ball 310 is in contact with the housing 100. The second protection mechanism is that the housing 100 is able to support the ball 310 and share the loading of the shaft 320. The impact applied on the shaft 320 along the radial direction of the shaft 320 is reduced, and therefore bending or breaking of the shaft 320 is prevented.

In addition, the first rail 113 and the second rail 123 are detachably assembled to the first cover 111 and the second cover, respectively. Thus, when the annular groove 144, which is formed by the first rail 113 and the second rail 123, is worn out by abrasion or damaged by great impacts of the shaft 320, the user only needs to replace the first supporting ring 113*b* and the second supporting ring 123*b* by the new first supporting ring 113*b* and the new second supporting ring 123*b* but buy a new wrist exerciser 10.

Figure 5:
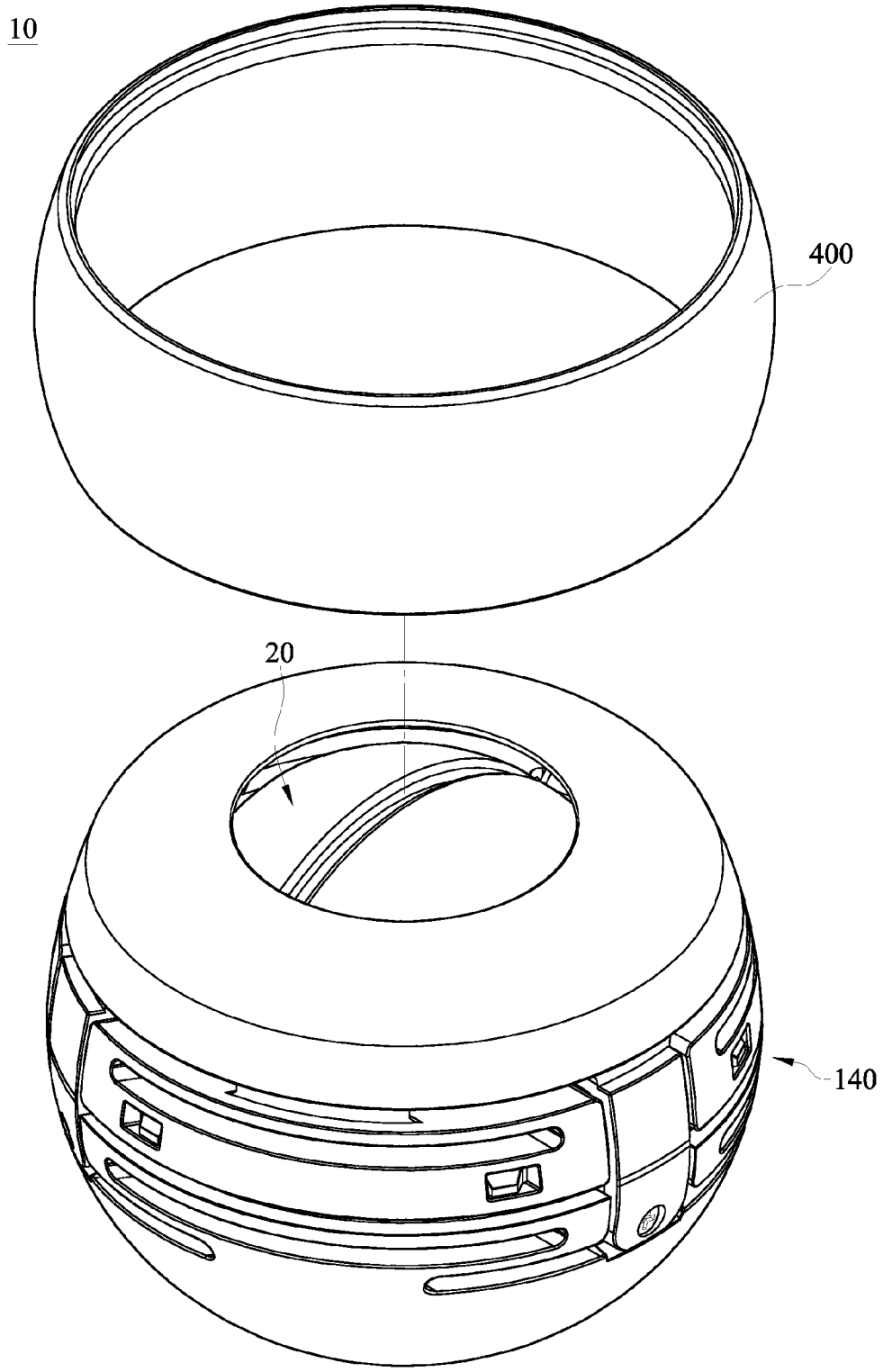
FIG. 5 is a perspective exploded view of the wrist exerciser and a protective ring according to the embodiment of the disclosure.
Figure 6:
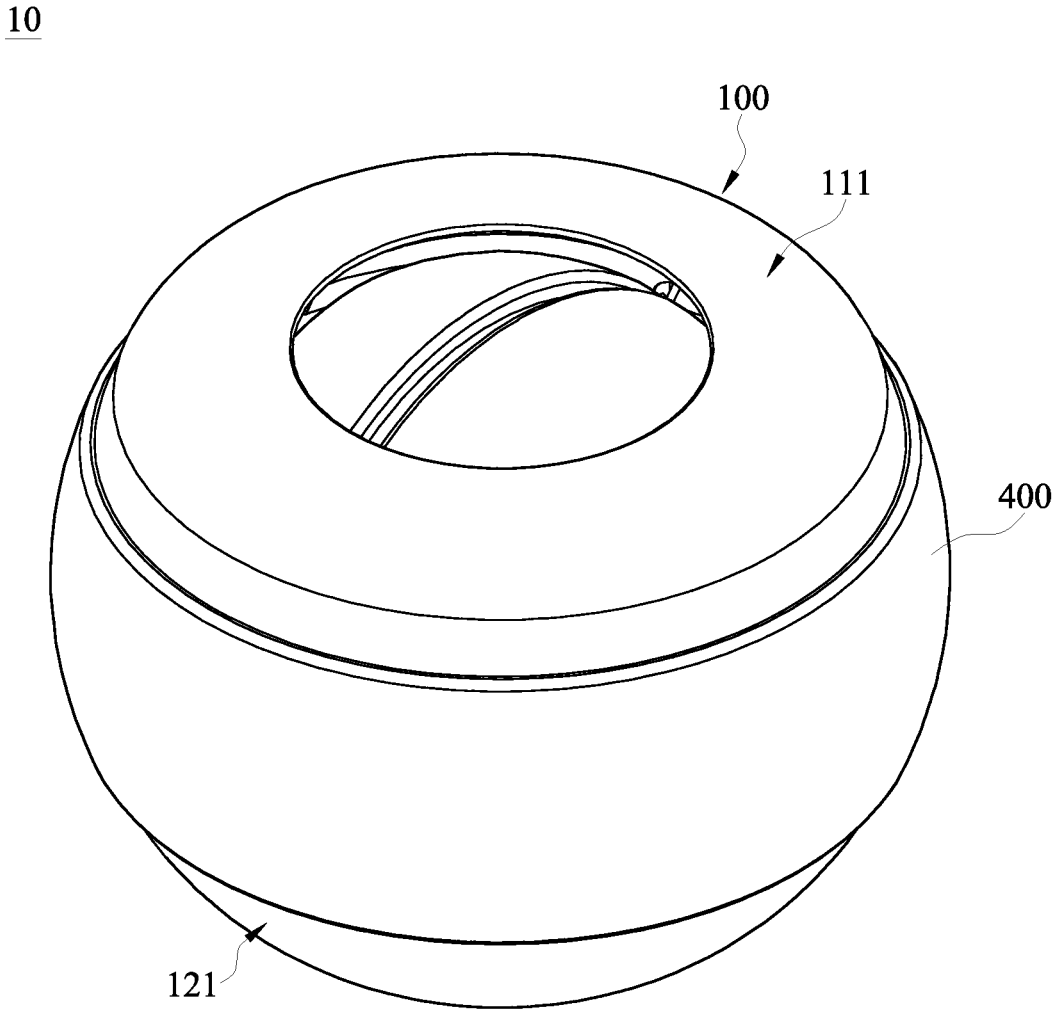
FIG. 6 is a perspective view of the wrist exerciser with the protective ring according to the embodiment of the disclosure.

Please refer to FIG. 5 and FIG. 6. FIG. 5 is a perspective exploded view of the wrist exerciser and a protective ring according to the embodiment of the disclosure. FIG. 6 is a perspective view of the wrist exerciser with the protective ring according to the embodiment of the disclosure. In this embodiment, the wrist exerciser 10 further includes a protective ring 400. The protective assembly 140 of the housing 100 is detachably wrapped with the protective ring 400. The protective ring 400 provides extra protection to the protective assembly 140 and prevents the protective assembly 140 from exposing. In addition, the protective ring 400 is made of, for example, plastic which has a greater friction coefficient than the housing 100. Thus, it is more comfortable for the user to grip the wrist exerciser 10 through the protective ring 400, and it is easier for the user to firmly grip the wrist exerciser 10 as well as prevent dropping the wrist exerciser 10 accidentally.

Figure 7:
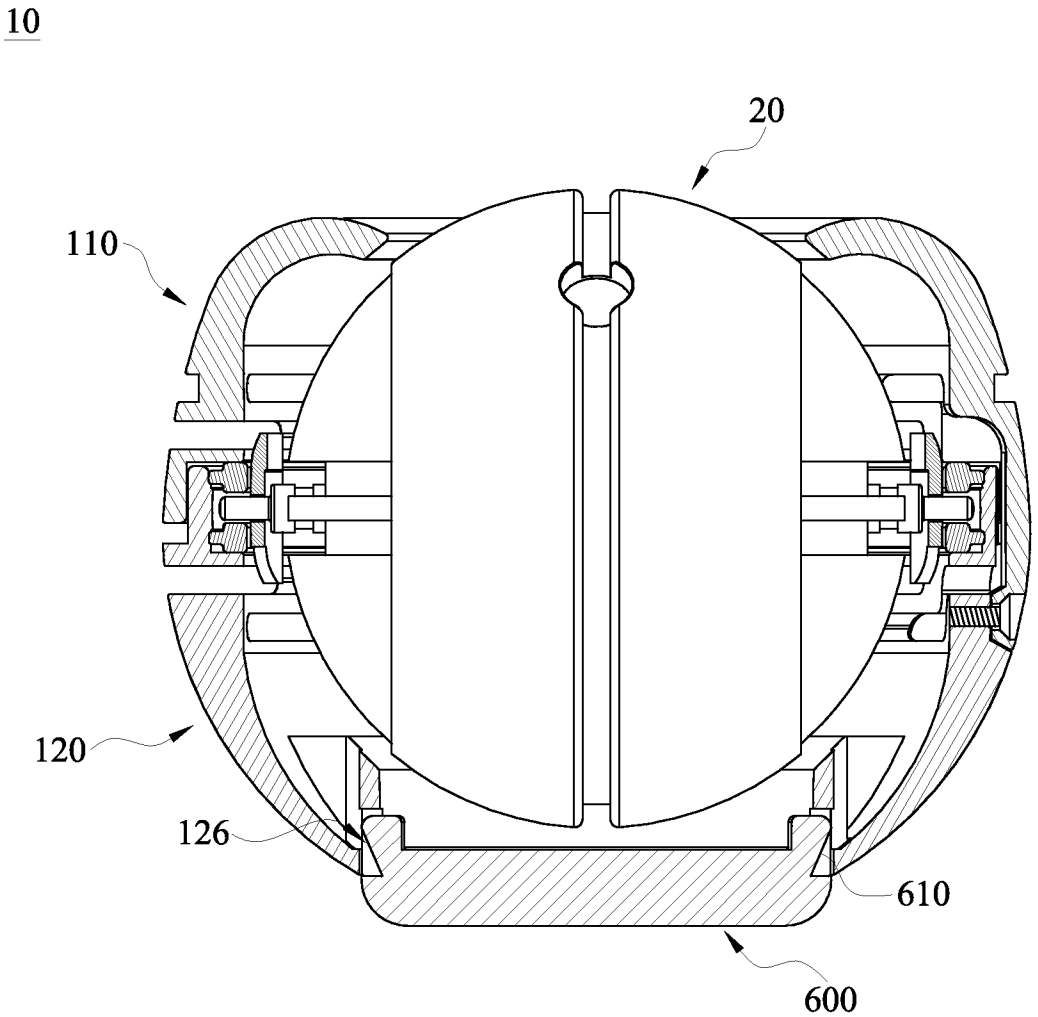
FIG. 7 is a cross-sectional view of the wrist exerciser and a sensor according to the embodiment of the disclosure.

Please refer to FIG. 7, is a cross-sectional view of the wrist exerciser and a sensor according to the embodiment of the disclosure. In this embodiment, the wrist exerciser 10 further includes a sensor 600, and the sensor 600 is disposed on an opening 126 of the second shell 120. In detail, the sensor 600 includes a hook 610 which is detachably fastened to the opening 126 of the second shell 120. The sensor 600 is for measuring a rotational speed of the ball 310 and displaying the rotational speed or transmitting a signal of the rotational speed of the ball 310 to other electronic devices.

According to the wrist exerciser as discussed above, the rail is able to move with the buffer portion within the maximum displacement determined by the buffer ability of the buffer portion, and therefore the shaft and the ball are able to move with the rail. As a result, the impact force concentrated at the contact area of the shaft and the ring is minimized. Thus, the protective assembly is able to absorb impacts applied to the shaft and prevent the shaft from bending. Furthermore, the supporting portion is disposed alongside the protective assembly, and the stiffness of the supporting portion is greater than the stiffness of the protective assembly. Thus, when the user grips the wrist exerciser and applies force on the housing, the supporting portion is able to support the first cover and the second cover for maintaining a required distance between the first cover and the second cover. Hence, when the grip applied on the housing becomes stronger, the deformation of the housing of the wrist exerciser is limited for maintaining the function of the ball.

In addition, when the ball is in contact with the housing, the housing is able to support the ball and share the loading of the shaft 320. The impact applied on the shaft 320 is reduced, and therefore bending or breaking of the shaft 320 is prevented.

What is claimed is:

1. A wrist exerciser, comprising:

a housing comprising a first cover, a second cover, at least one supporting portion and at least one protective assembly, the at least one supporting portion and the protective assembly disposed between the first cover and the second cover, the housing having an interior and exterior surface, the exterior surface being configured to come into contact with a user's hand during use, where the at least one supporting portion is disposed on the exterior surface, two ends of the at least one supporting portion that are opposite to each other being in contact with the first cover and the second cover, respectively, and a stiffness of the at least one supporting portion being greater than a stiffness of the at least one protective assembly, the at least one protective assembly comprising a rail and a buffer portion, and the buffer portion corresponding to the rail; and a gyroscopic member, comprising:

a ring disposed in the housing and slidably disposed on the rail; and a rotor comprising a ball and a shaft, the ball disposed in the housing, the shaft penetrating the ball, and two ends of the shaft that are opposite to each other being pivotally connected to the ring.

2. The wrist exerciser according to claim 1, wherein the first cover and the at least one supporting portion are formed as a single unit, and the at least one supporting portion has a free end which is connected to the second cover.

3. The wrist exerciser according to claim 1, further comprising a fixing member, the housing further comprising a fixed portion, the fixed portion connected to the second cover and extending toward the first cover, the at least one supporting portion having a first fixing hole, the fixed portion having a second fixing hole, and the fixing member penetrating the first fixing hole and the second fixing hole.

4. The wrist exerciser according to claim 1, wherein a quantity of the at least one protective assembly is plural, each of the rails of the protective assemblies is connected to the adjacent rail in a row, and the at least one supporting portion is across the rails.

5. The wrist exerciser according to claim 1, wherein the housing further comprises a first connecting portion, the buffer portion comprises a first buffer component, the first buffer component is connected to the first cover through the first connecting portion, and the at least one supporting portion and the first buffer component are spaced apart.

6. The wrist exerciser according to claim 5, wherein a width of the first connecting portion is less than a width of the first buffer component, and at least one slot is formed between the first cover and the first buffer component.

7. The wrist exerciser according to claim 6, wherein the first buffer component has a plurality of first channels, a quantity of the at least one slot is plural, and orthogonal projections of the plurality of first channels on the first cover and orthogonal projections of the plurality of slots on the first cover show a rotating order.

8. The wrist exerciser according to claim 7, wherein the plurality of first channels are parallel to the plurality of slots.

9. The wrist exerciser according to claim 5, wherein the buffer portion further comprises a second buffer component which is detachably connected to the first buffer component.

10. The wrist exerciser according to claim 9, wherein the rail is connected to the second buffer component.

11. The wrist exerciser according to claim 9, wherein the first buffer component comprises a hook slot, the second buffer component comprises a hook, and the hook and the hook slot are fixed with each other.

12. The wrist exerciser according to claim 9, wherein the first buffer component has a first channel, the second buffer component has a second channel, and extending directions of the first channel and the second channel are both parallel to an annular groove of the rail.

13. The wrist exerciser according to claim 1, wherein the rail has an inner surface and an annular groove on the inner surface, the inner surface faces the rotor, the ring has an annular protrusion, and the annular protrusion is slidably disposed in the annular groove.

14. The wrist exerciser according to claim 13, wherein the housing comprises a first shell and a second shell, the protective assembly comprises a first buffer component and a second buffer component, an edge of the first shell has a first rail, the first cover and the first buffer component are disposed on the first shell, an edge of the second shell has a second rail, the second cover and the second buffer component are disposed on the second shell, the first shell is mounted on the second shell, the first shell and the second shell together form an accommodating space, the first rail and the second rail together form the annular groove of the rail, and the ring and the rotor are disposed in the accommodating space.

15. The wrist exerciser according to claim 14, wherein the first rail further comprises a first supporting groove and a first supporting ring, and the first supporting ring is detachably disposed in the first supporting groove.

16. The wrist exerciser according to claim 14, wherein the second rail further comprises a second supporting groove and a second supporting ring, and the second supporting ring is detachably disposed in the second supporting groove.

17. The wrist exerciser according to claim 1, wherein a maximum displacement of the buffer portion is greater than or equal to a distance between the ball and the housing.

* * * * *